US012349740B2

(12) United States Patent
Bray

(10) Patent No.: US 12,349,740 B2
(45) Date of Patent: Jul. 8, 2025

(54) EQUIPMENT AND METHODS FOR THE AUTOMATED ASSEMBLY OF INHALATION DEVICES AND COMPONENTS THEREOF

(71) Applicant: NICOVENTURES TRADING LIMITED, London (GB)

(72) Inventor: Andrew Bray, London (GB)

(73) Assignee: Nicoventures Trading Limited, London (GB)

( * ) Notice: Subject to any disclaimer, the term of this patent is extended or adjusted under 35 U.S.C. 154(b) by 588 days.

(21) Appl. No.: 17/426,068

(22) PCT Filed: Jan. 22, 2020

(86) PCT No.: PCT/GB2020/050145

§ 371 (c)(1),
(2) Date: Jul. 27, 2021

(87) PCT Pub. No.: WO2020/157467

PCT Pub. Date: Aug. 6, 2020

(65) Prior Publication Data

US 2022/0095699 A1 Mar. 31, 2022

(30) Foreign Application Priority Data

Jan. 29, 2019 (GB) ..... 190120

(51) Int. Cl.
*B23P 19/00* (2006.01)
*A24F 7/00* (2006.01)
(Continued)

(52) U.S. Cl.
CPC ..... *A24F 40/70* (2020.01); *A24F 7/00* (2013.01); *A24F 40/10* (2020.01); *A24F 40/20* (2020.01);
(Continued)

(58) Field of Classification Search
CPC ..... A24F 40/70; A24F 7/00; A24F 40/10; A24F 40/20; A24F 40/30; A24F 40/42;
(Continued)

(56) References Cited

U.S. PATENT DOCUMENTS 4,141,369 A 2/1979 Burruss
2015/0289565 A1* 10/2015 Cadieux ..... A24F 40/70 131/328
(Continued)

FOREIGN PATENT DOCUMENTS

AT 507188 B1 * 3/2010 ..... A24F 40/00
CA 3031241 A1 2/2018
(Continued)

OTHER PUBLICATIONS

English translation of AT-507188-B1 (Year: 2010).*
(Continued)

*Primary Examiner* — Jun S Yoo
(74) *Attorney, Agent, or Firm* — Merchant & Gould P.C.

(57) ABSTRACT

Equipment for the automated assembly of consumable units for use in an inhalation device from components that include a mouthpiece, a container defining a chamber for aerosolisable material, and a closure for the chamber, is disclosed. The equipment comprise at least one assembly line having one or more assembly stations that each comprises tooling for performing an assembly operation on the components, and a transport system for supplying the components to the assembly stations and advancing the components through the assembly stations in a sequence to assemble at least part of the device from the components. A process for the serial production of consumable units for use with an inhalation device is also disclosed.

8 Claims, 7 Drawing Sheets

(51) Int. Cl.

| | |
|---|---|
| ***A24F 40/10*** | (2020.01) |
| ***A24F 40/20*** | (2020.01) |
| ***A24F 40/30*** | (2020.01) |
| ***A24F 40/42*** | (2020.01) |
| ***A24F 40/70*** | (2020.01) |
| ***B65B 3/04*** | (2006.01) |
| ***B65B 7/28*** | (2006.01) |
| ***B65B 25/00*** | (2006.01) |
| ***B65B 65/00*** | (2006.01) |
| ***B65D 75/36*** | (2006.01) |

(52) U.S. Cl.
CPC ..... *A24F 40/30* (2020.01); *A24F 40/42* (2020.01); *B65B 3/04* (2013.01); *B65B 7/28* (2013.01); *B65B 25/00* (2013.01); *B65B 65/006* (2013.01); *B65D 75/367* (2013.01)

(58) Field of Classification Search
CPC ..... B65B 3/04; B65B 7/28; B65B 25/00; B65B 65/006; B65D 75/367
See application file for complete search history.

(56) References Cited

U.S. PATENT DOCUMENTS

| | | | | |
|---|---|---|---|---|
| 2015/0291301 | A1 | 10/2015 | Cadieux et al. | |
| 2016/0331913 | A1 | 11/2016 | Bourque | |
| 2016/0338408 | A1* | 11/2016 | Guenther, Jr. ..... | B23P 21/004 |
| 2017/0121169 | A1* | 5/2017 | Dailey ..... | B65B 57/145 |
| 2020/0107580 | A1 | 4/2020 | Testoni et al. | |

FOREIGN PATENT DOCUMENTS

| | | | | |
|---|---|---|---|---|
| CN | 204994614 | U | 1/2016 | |
| CN | 106535669 | A | 3/2017 | |
| CN | 106535678 | A | 3/2017 | |
| CN | 107568798 | A | 1/2018 | |
| CN | 108025817 | A | 5/2018 | |
| CN | 113329943 | B | 11/2023 | |
| JP | 2011182710 | A1 | 9/2011 | |
| JP | 7288512 | B2 | 5/2023 | |
| WO | 2015186000 | A2 | 12/2015 | |
| WO | WO 2016/156500 | A1 | 10/2016 | |
| WO | WO-2017051350 | A2 * | 3/2017 | ..... B65B 1/06 |
| WO | WO 2019/003127 | A2 | 1/2019 | |
| WO | WO 2020/157467 | A2 | 8/2020 | |

OTHER PUBLICATIONS

International Search Report and Written Opinion for International Application No. PCT/GB2020/050145, dated Jul. 27, 2020, 14 pages.
Partial Search Report for International Application No. PCT/GB 2020/050145, dated Jul. 27, 2020, 7 pages.
"International Preliminary Report on Patentability for Application No. PCT/GB2020/050145, mailed on Aug. 12, 2021", 10 pages.
"Office Action and Search Report mailed May 12, 2022 for Chinese Application No. 202080011595.4", 11 pages.
"Office Action received for Indonesian Patent Application No. P00202105340, mailed on Jun. 20, 2024", 6 pages (3 Pages of English Translation and 3 Pages of Official Copy).
Mexican Office Action in MX Appln. No. MX/a/2021/009034, dated Sep. 18, 2024, 4 pages.
ID Office Action in ID Appln. No. P00202105340, dated Oct. 22, 2024, 3 pages.

* cited by examiner

EQUIPMENT AND METHODS FOR THE AUTOMATED ASSEMBLY OF INHALATION DEVICES AND COMPONENTS THEREOF

RELATED APPLICATION INFORMATION

The present application is a National Phase entry of PCT Application No. PCT/GB2020/050145, filed Jan. 22, 2020, which claims priority from GB Patent Application No. 190120.2, filed Jan. 29, 2019, each of which is hereby fully incorporated herein by reference.

TECHNICAL FIELD

This patent specification relates to equipment and methods for the automated assembly of inhalation devices and components thereof.

SUMMARY OF THE DISCLOSURE

This patent specification discloses equipment and methods of manufacture of inhalation devices and components thereof, in particular, consumable units for the delivery of vapor generated without combustion in an inhalation device.

In an embodiment disclosed herein, an inhalation device comprises: an operating unit of a size and shape suitable to be held by an adult consumer; a first consumable unit removably attachable to the operating unit and comprising an atomiser cartridge for atomising a consumable liquid; a second consumable unit comprising a mouthpiece assembly formed of a mouthpiece and a container, the second consumable unit being removably attachable to the first consumable unit, the container being mounted in the mouthpiece and containing a charge of aerosolizable material. The container includes a closure for retaining the material within the container.

In use, the operating unit delivers energy to the consumable units under the control of the consumer as the consumer draws air through the device. The liquid in the first consumable unit is atomised to form an aerosol and the aerosolizable material in the container of the second consumable unit is volatilized, releasing volatile flavours. The air inhaled from the device therefore delivers an aerosol of atomised liquid from the atomiser cartridge to the consumer together with the vapor generated by heating the particulate material in the container of the mouthpiece assembly. The compositions of the aerosolizable material and the consumable liquid may be selected to deliver a wide combination of flavours that appeal to the consumer.

The inhalation device may be offered to consumers as an assembled unit, which includes the first and second consumable units already attached to the operating unit, or separated from the operating unit but packaged together with it. Alternatively, the inhalation device may be offered as package of components comprising one or more first and/or second consumable units, optionally together with an operating unit, so that the consumer may assemble the components into an operational inhalation device by attaching the first and second consumable units to the body portion. When a consumable unit has been exhausted of its contents, the consumer may remove it from the body portion and replace it with a fresh unit.

Where the volatilizable liquid in the atomiser cartridge is consumed more slowly than the particulate material in the second consumable unit, it may be desirable to package the first and second consumable units separately from the operating unit. In one embodiment, one or more atomiser cartridges are packaged with multiple mouthpiece assemblies, e.g. 2, 3, 4 or more, for each atomiser cartridge, depending on the quantity of consumable material in each container and the volume of volatilizable material in the atomiser cartridge.

Accordingly this specification discloses a retail sales package containing components of an inhalation device including at least one first consumable unit for an inhalation device and comprising an atomiser cartridge for atomizing a consumable liquid, and, for each of the first consumable units, a plurality of second consumable units, or mouthpiece assemblies, each provided with a charge of particulate material capable of generating, when heated, a vapor for inhalation by the consumer, the first and second consumable units being adapted for assembly together with an operating unit to form an operable inhalation device when removed from the packaging.

This patent specification also discloses a process for the serial production of the second consumable units. According to one embodiment, consumable units of an inhalation device are formed from components that include a mouthpiece, a container defining a chamber for particulate aerosolizable material, and a closure for the chamber, the process comprising:

an assembly operation, in which each of a series of containers is assembled with a respective mouthpiece in an operational configuration to form a series of mouthpiece assemblies;

a dosing operation in which a measured quantity of the particulate material is loaded into the respective chambers of each of a series of successive containers; and a sealing operation in which each of a succession of closures is applied to each successive container.

The process may be carried out in a sequence such that the dosing operation is performed before the sealing operation and the assembly operation is performed after the sealing operation.

Alternatively, the process may be carried out in a sequence such that the assembly operation is performed before the loading operation, and sealing operation is performed after the loading operation.

In one embodiment, a process for the serial production of inhalation devices from components that include a mouthpiece, a container defining a chamber for particulate aerosolizable material, and a closure for the chamber comprises the following: at a first workstation, assembling each of a series of containers with a respective mouthpiece in an operational configuration to form a mouthpiece assembly; advancing the assembly from a first workstation to second work station; at the second workstation loading a measured quantities of the particulate material into the respective chambers of each successive container; advancing the loaded mouthpiece assemblies in succession from the second assembly station to a third workstation; and at the third workstation sealing the closure to each successive mouthpiece assembly.

This specification discloses equipment for the automated assembly of consumer units of the kind described above from components that include a mouthpiece, a container defining a chamber for particulate aerosolizable material, a closure for the chamber, and a supply of particulate material.

The equipment generally comprises at least one assembly line having one of more assembly stations, the or each station comprising tooling for performing an assembly operation on the components, and a transport system for supplying the components to the assembly stations and advancing the components through the assembly stations in a sequence to assemble the consumable units from the components.

In the assembled consumable unit, the mouthpiece is connected to the container, the container is loaded with particulate material, and the closure is connected to the container to close the chamber.

In one embodiment, the transport system comprises a mouthpiece delivery system constructed and arranged to deliver mouthpieces in succession to a mouthpiece assembly station, and a container delivery system constructed and arranged to deliver containers in succession to the mouthpiece assembly station; and the mouthpiece assembly station comprises tooling constructed and arranged to assemble a container and a mouthpiece in their operational configuration to form a mouthpiece assembly.

In one embodiment, the chamber in the container is defined by the closure at one end and by a partition formed separately from the container and positioned at the other end. For the assembly of mouthpiece assemblies with such containers, the transport system comprises a partition delivery system constructed and arranged to deliver partitions in succession to the mouthpiece assembly station, and the mouthpiece assembly station comprises tooling constructed arranged to assemble a container, a mouthpiece and a partition in their operational configuration to form a mouthpiece assembly.

The container delivery system may deliver the containers empty, for filling and sealing at subsequent assembly stations or stations, or the containers may be pre-filled and closed prior to delivery to the mouthpiece assembly station, whereby the containers delivered contain a measured quantity of aerosolizable material retained within the container by the closure.

Where the containers are delivered empty, the transport system may comprise a transfer system constructed and arranged to transfer mouthpiece assemblies in succession to a loading or dosing station, and a material delivery system constructed and arranged to deliver the aerosolizable material to the dosing station; and the dosing station comprises tooling constructed and arranged to load measured quantities of the particulate material into the respective chambers of each successive container.

The transport system may further comprises a transfer system for transferring loaded mouthpiece assemblies in succession station to a closing station, and a closure delivery system constructed and arranged to deliver closures in succession to the closing station; and the closing station comprises tooling constructed and arranged to apply and seal a closure to each successive mouthpiece assembly.

In an alternative embodiment, where the containers are filled and closed prior to assembly with the mouthpieces, the transport system may comprises a container delivery system constructed and arranged to deliver empty containers in succession to the loading or dosing station, and a material delivery system constructed and arranged to deliver the aerosolizable material to a dosing station; and the dosing station comprises tooling constructed and arranged to load measured quantities of the particulate material into the respective chambers of each successive container.

This embodiment may further comprise a transfer system for transferring loaded containers in succession to a closing station, and a closure delivery system constructed and arranged to deliver closures in succession to the closing station; and the closing station comprises tooling constructed and arranged to apply and seal a closure to the container of each successive mouthpiece assembly.

The transport system may then further comprise a mouthpiece delivery system constructed and arranged to deliver mouthpieces in succession to a mouthpiece assembly station, and a container transfer system constructed and arranged to deliver filled and closed containers in succession to a mouthpiece assembly station; and the mouthpiece assembly station may comprise tooling constructed arranged to assemble the filled and closed containers with respective mouthpieces in their operational configuration to form mouthpiece assemblies.

In any of the embodiments just described, the equipment may comprise a further assembly station, a further transfer system constructed and arranged to transfer assembled mouthpiece assemblies to the further assembly station, and a component delivery system for delivering further components of the device to the assembly station, the assembly station being constructed an arranged to combine the assembled devices with one or more further components.

For example, in one embodiment, the further components may comprise operating units of the inhalation device each having been pre-assembled with a first consumable unit (the atomiser cartridge), and the further assembly station may be constructed and arranged to assemble second consumable units (the mouthpiece assemblies) with the pre-assembled operating unit and atomiser cartridge to form a finished product.

Alternatively, the further component may comprise packaging for the device. Accordingly, in another embodiment, the further station may comprise a packaging station, a transfer system for delivering assembled components to the packaging station, and a packaging delivery system constructed and arranged to deliver packaging material to the packaging station, the packaging station being constructed and arranged to pack the consumable units in the packaging material.

Where the volatilizable liquid in the cartridge unit is consumed more slowly than the material in the container of the mouthpiece assembly, it may be desirable to package one or more atomiser cartridges with multiple mouthpiece assemblies, e.g. 2, 3, 4 or more, for each cartridge unit, depending on the quantity of consumable material in each mouthpiece assembly and the volume of volatilizable material in the atomiser cartridge. Accordingly, in another embodiment, the further station may comprise a packaging station that comprises a transfer system for delivering mouthpiece assemblies to the packaging station, a delivery system constructed and arranged to deliver a succession of atomiser cartridges to the packaging station, and a packaging delivery system constructed and arranged to deliver packaging material to the packaging station, the packaging station comprises tooling constructed and arranged to pack the assembled devices in the packaging material to form packs of atomiser cartridges and mouthpiece assemblies in the required numerical proportions.

If the rate of assembly of components of the device at an early station in the line, for example the assembly of the container and mouthpiece, is slower that at a later station, for example a packaging station, it may be necessary to slow down the operation of the later station. A more efficient operation may be achieved by providing equipment comprising a plurality of lines for assembling the container and mouthpiece, and a common collection system for collecting assembled devices from the assembly lines. For example, a single common collection system may be arranged to collect assembled sub-components from least two, four six, eight or more similar assembly lines, and to transfer them to a common further assembly station for final assembly or for packaging.

In such equipment, the common collection system may for example comprise a conveyor having carriages or trays adapted to hold two or more, e.g. 3, 6, 8, 9, 10, 12 or higher multiples of mouthpiece assemblies and each of the sub assembly lines may include a transfer system constructed and arranged the load the assembled devices into the carriages or trays.

The transport system may comprise one or more conveyors. The conveyors may be of any appropriate construction and may comprise roller conveyors, chain conveyors, belt, cable, chain or slat conveyors and or elevators, which may be arranged in an endless configuration or in a shuttle configuration, and which may incorporate multidirectional or rotational transfer tables. The conveyor system may also be beltless, and constructed for example from linear synchronous motors or linear induction drives.

The aerosolizable material may comprise tobacco. Alternatively or additionally, the aerosolizable material comprises a particulate material, for example a particulate tobacco material.

BRIEF DESCRIPTION OF THE DRAWINGS

Embodiments of the equipment, process, device, consumable units and packaged product will now be described, by way of example only, with reference to the accompanying drawings, in which.

In the drawings, for ease of reference similar components, systems or features have been given like reference numerals.

DETAILED DESCRIPTION

Inhalation Device and Components

Figures 1A, 1B, 1C:
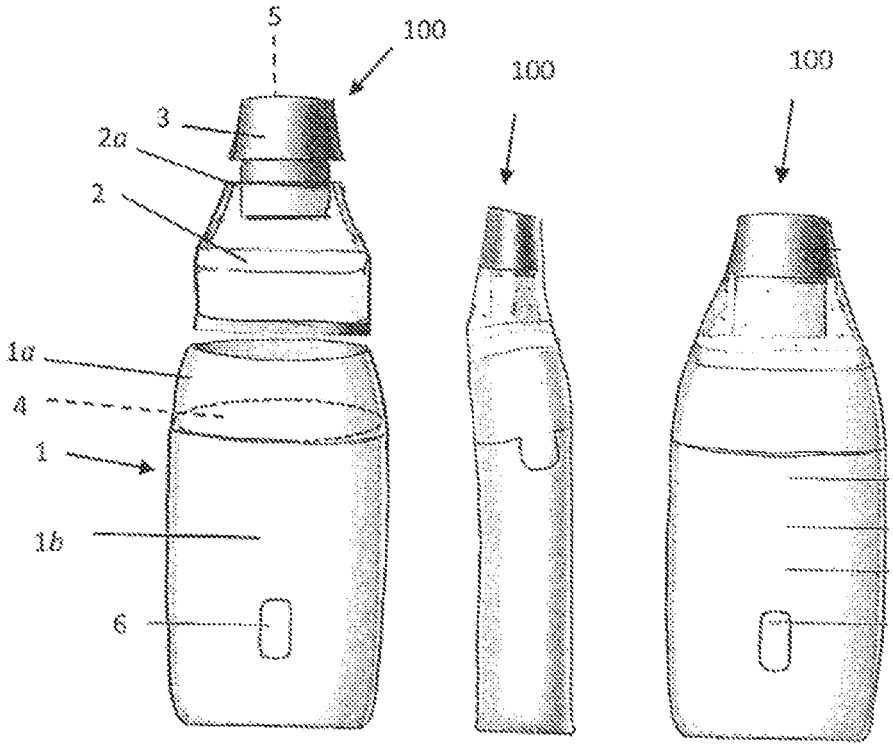
FIGS. 1A, 1B and 1C illustrate one embodiment of a hand-held inhalation device in partially exploded view, side elevation and front elevation respectively.

Referring to FIGS. 1A-C, 2A and 2B, an inhalation device, indicated generally at 100 is intended for the delivery of vapor generated by the heating of particulate botanical material such as tobacco, without combustion, and the volatilization of a liquid containing one or more active ingredients, in particular flavorants, which may be tobacco based and may include nicotine, together with a carrier. The device has three hollow sections of moulded plastics materials: a body 1, containing an operating system and mechanism for device, and two consumable units, namely a first consumable unit in the form of an atomiser cartridge 2 containing a volatilizable liquid flavorant, and second consumable unit in the form of a mouthpiece assembly 3 containing a dose of material which generates an aerosol when heated. The three sections are removably connected to each other so that the atomiser cartridge 2 and the mouthpiece assembly 3 can each disconnected from each other and the body 1, to allow replacement consumable units of either kind to be fitted to the body.

The body 1 is of a generally cylindrical shape that is elongated in an axial direction and flattened so as to be held comfortably in the hand of an adult consumer. The body 1 is formed from two axially-aligned, hollow moulded sections, an upper section 1*a* and a lower section 1*b*. The upper section of the body has an open upper end and a closed lower end wall 4 that define a recess for receiving the atomiser cartridge 2. The lower section 1*b* of the body is closed off from the upper section by the lower end wall 4 of the upper section 1*a* to provide a firewall. The lower section of the body contains a battery, an electronic circuit board, a puff sensor and other operating components, not illustrated here, which may be activated by an operating button 6 in one face of the body 1. Electrical lights housed in apertures in the body 1 indicate the state of operation of the device.

Figure 2A:
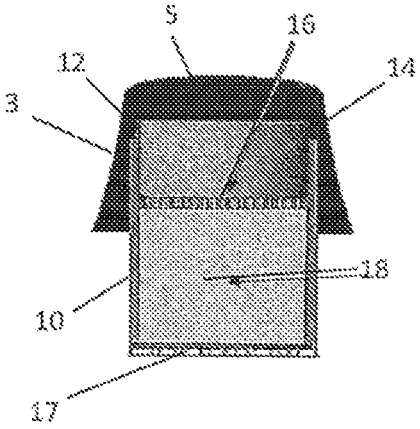
FIG. 2A is an axial cross section of a consumable unit in the form of a mouthpiece assembly forming one component of the device of FIGS. 1A to 1C.
Figure 2B:
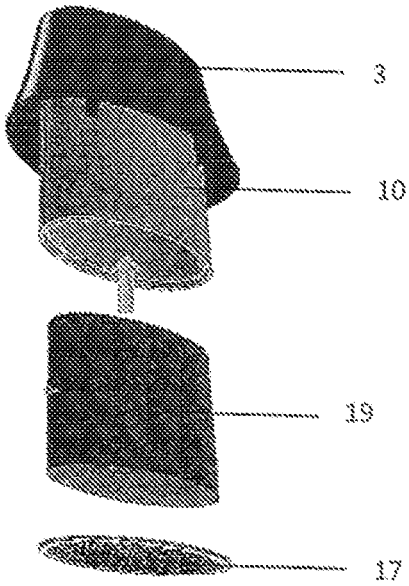
FIG. 2B is an exploded view, in perspective, of the mouthpiece assembly of FIGS. 2A.
Figure 2C:
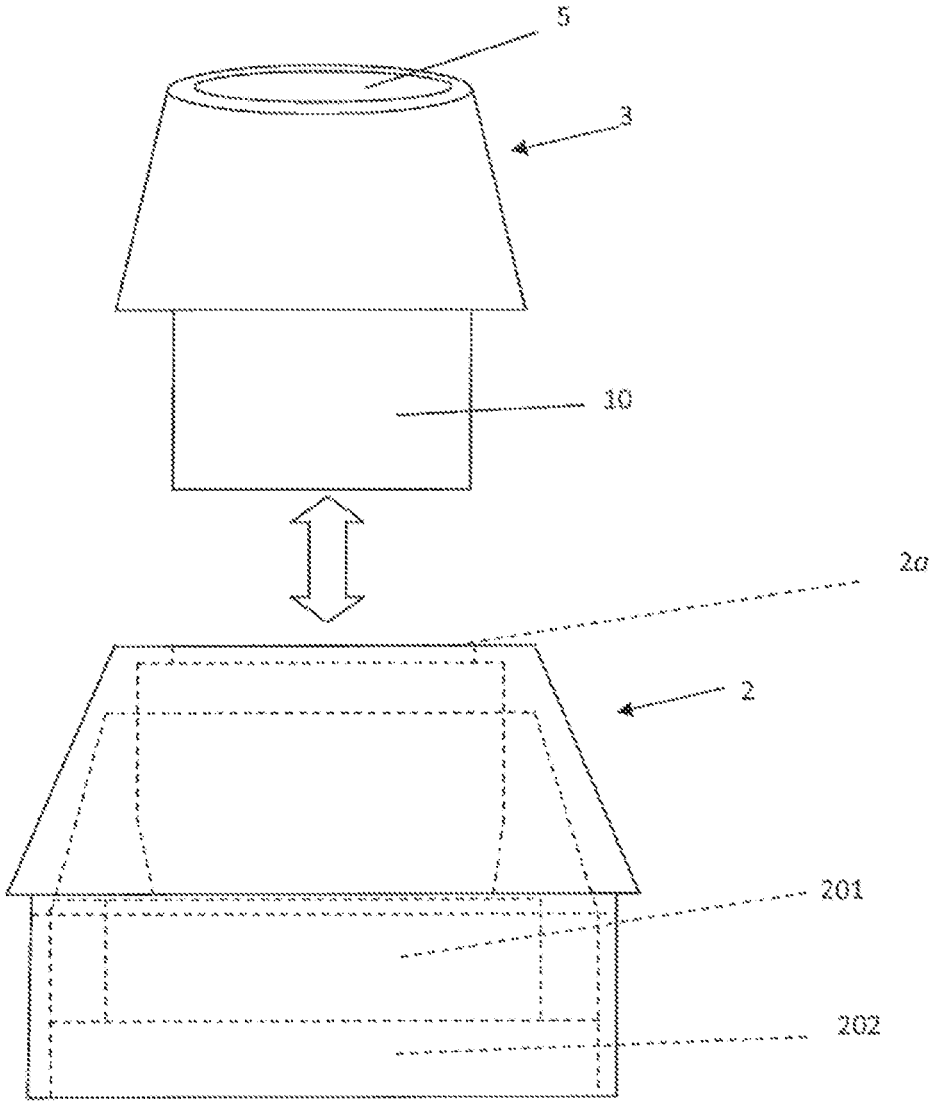
FIG. 2C is a schematic view of the mouthpiece assembly of FIGS. 2A and 2B together with another first consumable unit in the form of an atomiser cartridge, which forms another component of the inhalation device.

As indicated in FIGS. 1A and 2C, the atomiser cartridge 2 is removably connected to the body 1 by a push fit connection into the recess in the upper body section 1*a*, and tapers in the axial direction away from the body 1 towards an upper outlet 2*a*. The cartridge 2 contains a reservoir 201 filled with volatilizable liquid flavorant and a heating element 202 for volatilising the liquid to which the supply of electricity may be controlled from the battery in the body 1 by the operating button 6.

The mouthpiece assembly 3 is removably connected to the atomiser cartridge 2 by a push fit connection into the upper outlet 2*a* of the atomiser cartridge 2. The external surface of the mouthpiece forms a skirt that continues the tapering shape of the atomiser cartridge 2 in the axial direction towards a vapor outlet 5, which is shaped to be held comfortably in the mouth of the consumer.

As best seen in FIGS. 2A and 2B, an axially-extending open-ended container 10 of elliptical radial cross-section is mounted within the mouthpiece assembly 3. One end of the container 10 lies within the skirt of the mouthpiece and terminates in a spigot 12, which is received within a socket 14 of complimentary shape formed on the interior surface of the mouthpiece upstream of the outlet 5. The mouthpiece may be connected to the container 10 by ultrasonic welding, induction welding or any other suitable method. An inner perforated screen 16, which in this embodiment is moulded integrally with the container 10, extends radially across the container 10 to define a vapor permeable partition across the container 10 a short distance upstream of the outlet 5. The other end of the container 10 projects from the skirt of mouthpiece and is provided with a closure 17, also in the form of a perforated screen. The closure 17 is composed for example of a mesh or foil or a moulding of plastics material, which may be attached to the end wall of the container 10 by ultrasonic welding, induction welding or other suitable methods. The two screens 16, 17 define the end walls of a chamber 18 within the container 10 in which a dose 19 of particulate tobacco material may be held. The perforations in the screens allow vapor to pass in the axial direction downstream through the chamber towards the mouthpiece and are of a size that is selected in relation to the particle size of the tobacco material to prevent the tobacco particles from falling from the container 10, or being drawn into the mouthpiece with inhaled vapor.

Figure 8:
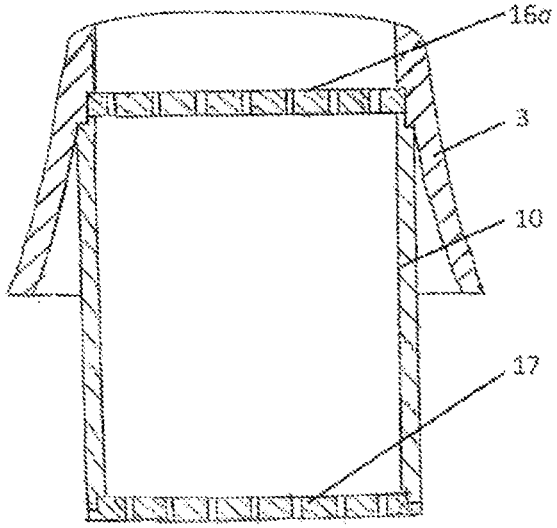
FIG. 8 is an axial cross section cross through an alternative mouthpiece assembly to that shown in FIG. 2A.

FIG. 8 illustrates an alternative construction for the mouthpiece assembly 3 in which the inner perforated screen of the container of FIG. 2*a* is replaced by a perforated screen 16*a* that extends across the inner end of the container 10 and lies between the socket of the mouthpiece and the container 10.

In use, the consumer switches on the device using the operating button 6, sucks through the mouthpiece and inhales the vapor drawn from the device. When activated, the electronic system within the body 1 heats the air in the device and the liquid in the atomiser cartridge 2 sufficiently to cause atomisation. The heated air volatilises flavorants from the particulate material within the container 10 and also entrains atomised liquid flavorant from the atomiser cartridge 2. A combination of flavorants is thereby delivered to the consumer as an aerosol for inhalation.

Packaged Product

The inhalation device 100 and the first and second consumable units 2, 3 may be packaged for sale to consumers in a variety ways. For example, the device 100 may be packaged as a complete assembly comprising a single body, a single atomiser cartridge 2 and single mouthpiece assembly 3, as illustrated in FIG. 1C. Alternatively, the device may be packaged for sale in combination with one or more replacement consumable units, or the consumable units may be packaged separately from the body unit, for example in packs of containing one or more mouthpiece assemblies 3 or one or more atomiser cartridges 2.

Figure 3A:
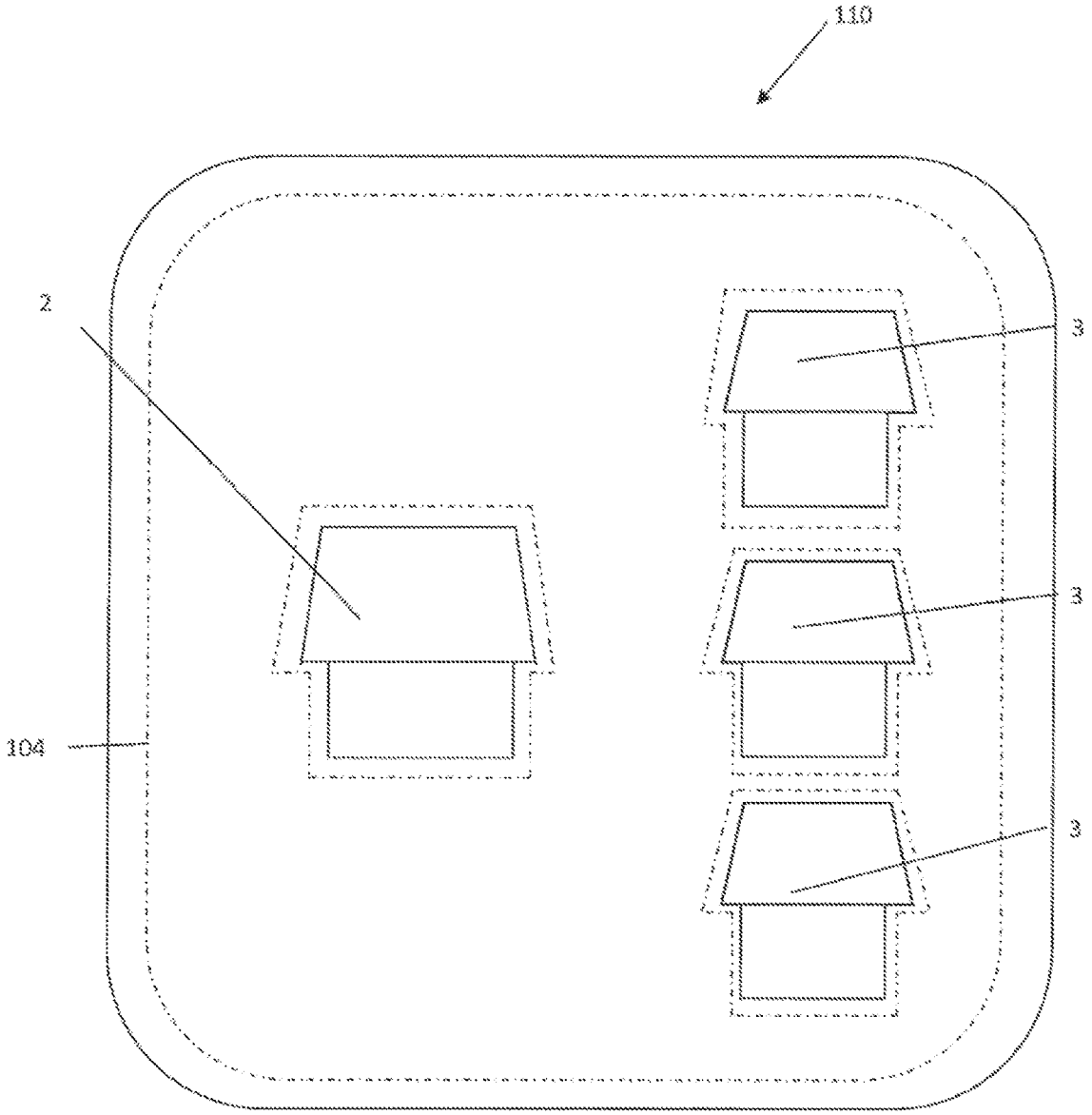
FIG. 3A is a plan of a packaged product containing consumable units for the inhalation device of FIGS. 1A to 1C.
Figure 3B:
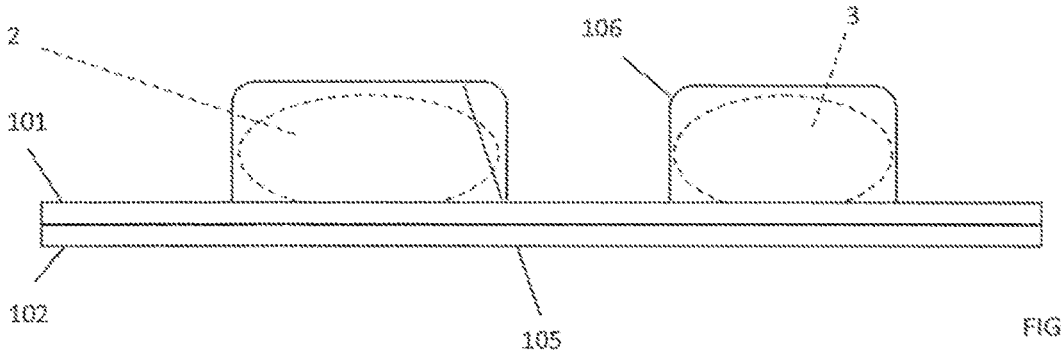
FIG. 3B is an elevation of the packaged product of FIG. 3A

In the embodiment illustrated in FIGS. 1A to 1C, the volatilizable liquid in the atomiser cartridge 2 is consumed more slowly than the material in the mouthpiece assembly 3, so that a single atomiser cartridge 2 contains sufficient liquid for consumption with more than one mouthpiece assembly 3, e.g. three mouthpiece assemblies. Accordingly, a useful packaged product for retail sale to a consumer may contain a single atomiser cartridge 2 and three mouthpiece assemblies 3. An example of such a packaged product is illustrated in FIGS. 3A and 3B. The packaged product comprises a single atomiser cartridge 2 with a full load of aerosolizable material, and three mouthpiece assemblies 3, each carrying a full load of particulate tobacco material.

The packaged items are contained in a blister pack 110 formed from two sheets of plastics material 101, 102 sealed together in a peripheral seam 104. The upper sheet 101 is transparent, the lower sheet 102 may be opaque. The upper sheet is moulded to provide a single pocket 105 shaped to accommodate one atomiser cartridge, and three pockets 106 each shaped to accommodate a single one of the second mouthpiece assemblies 3. A sheet of printed material containing instructions and product information may be enclosed with in the package, between the upper and lower sheets.

Assembly Equipment and Process

The automated assembly of the second consumable unit 3 (mouthpiece assembly) is affected in embodiments of the equipment described below. The assembly of the mouthpiece assembly 3 involves three steps, namely (1) mounting the container 10 within the mouthpiece, (2) loading the container with a dose of tobacco and (3) closing the container with the screen 22, not necessarily carried out in that order. For example, the container 10 may be loaded and closed before being assembled into the mouthpiece. Alternatively, the empty container may be assembled with the mouthpiece, and then loaded and closed.

Figure 4:
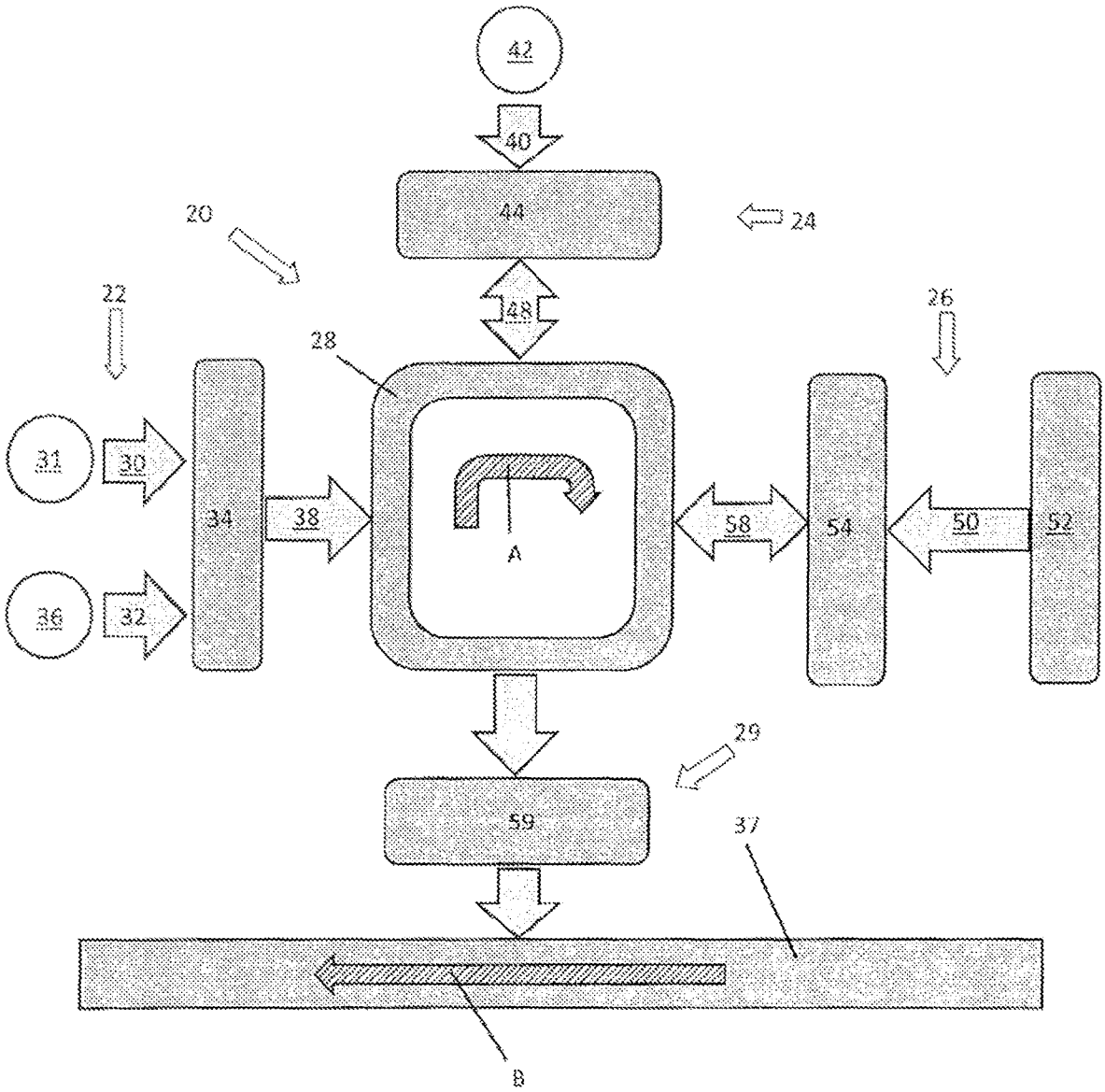
FIG. 4 is a schematic drawing of a first embodiment of equipment for the automated assembly of the mouthpiece assembly of FIGS. 2A and 2B.
Figure 5:
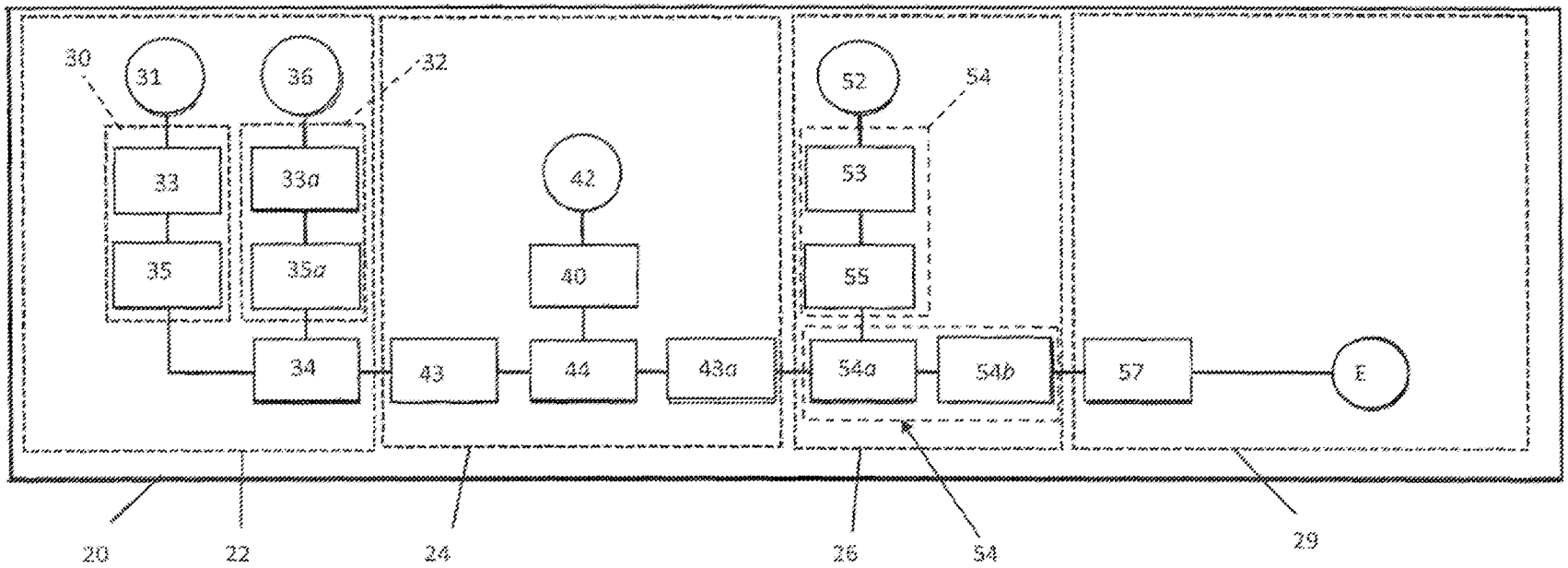
FIG. 5 is a flow chart of the assembly process performed by equipment described with reference to FIG. 3.

FIG. 4 illustrates schematically a first embodiment of equipment for the automated assembly of the mouthpiece assemblies 3 of the inhalation devices 1. FIG. 5 is a process map illustrating the sequence of operations carried out in the equipment.

The equipment comprises an assembly line indicated generally at 20 having a group of three assembly stations, indicated generally at 22, 24, 26, that each comprises tooling for performing assembly operations on the components of the mouthpiece assembly 3. The assembly line includes a fourth station, indicated generally at 29, at which assembled components are taken off the conveyor 28 for further processing via a further transport system such as a conveyor 37.

The assembly stations are each supplied with components and connected to each other by a transport system that includes various transfer mechanisms, indicated schematically in the drawing by arrows, which transfer the components into and out of the assembly stations, and a conveyor 28 which advances the components through the assembly stations in a sequence, in the direction indicated by the arrow A, to assemble the mouthpiece assemblies 3. The conveyor 28 is laid out to define a closed loop path through the assembly stations. It may incorporate linear induction drive technology or independent moving cart technology (known as XTS technology).

Figure 7:
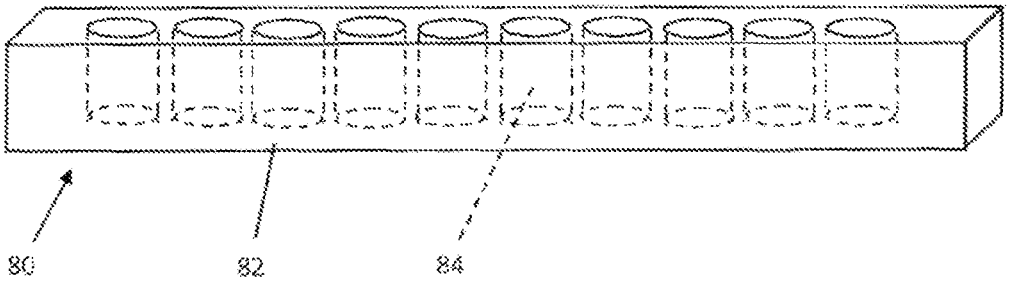
FIG. 7 is a schematic drawing of a carriage used in the equipment of FIGS. 4 and 6.

It may be convenient to manufacture assemblies in groups so that each assembly operation is performed simultaneously on multiple mouthpiece assemblies. For this purpose the conveyor may be constructed to advance groups of assemblies through the assembly stations in carriages, referred to in the art as pucks or trays, one of which is illustrated schematically in FIG. 7. The carriage 80 comprises a frame 82 that is provided with a number of compartments 84, in this case ten, each configured and adapted to receive a mouthpiece assembly. The optimum number of compartments per carriage will depend up on the nature of subsequent assembly steps. The compartments may be arranged in a single row, as illustrated, or in more than one row to provide an array of compartments, for example 3 rows of 3 (a 3×3 array), a 2×4 array, a 2×5 array in accordance with the transfer mechanism used.

The first assembly station, or mouthpiece assembly station 22, comprises a mouthpiece delivery system 30 and container delivery system 32. The mouthpiece delivery system 30 is constructed and arranged to transfer mouthpieces from a source 31, such as a hopper or stack, and to deliver the mouthpieces in an orderly succession and in a desired orientation to mouthpiece assembly tooling 34. As indicated in FIG. 5, this system may include an unpacking operation 33 and/or a sorting operation 35. The ordering and orientation of the assemblies may be affected for example in a centrifugal or bowl feed system. The feed system may be constructed to deliver the mouthpieces in multiple streams (e.g. in pairs, threes, fours etc.) so that the mouthpieces are delivered for subsequent simulations handling and processing in numbers appropriate for the number of compartments 84 in the carriage 80.

Similarly, the container delivery system 32 is constructed and arranged to transfer mouthpieces from a source 36, such as a hopper or other source of supply, and to deliver the containers in an orderly succession and in a desired orientation to the mouthpiece assembly tooling 34. This process may also include an unpacking operation 33*a* and/or a sorting operation 35*a*, as indicated in FIG. 5, which may also be affected for example in a centrifugal or bowl feed system. The feed system may be also be constructed to deliver the containers in multiple streams for simultaneous handling and processing.

The mouthpiece assembly tooling 34 is constructed and arranged to assemble each successive container 10 with a respective mouthpiece by bringing the two components together in axial alignment, inserting the spigot 12 on the open end of the container 10 into the socket 14 within the mouthpiece, and joining the two components together, for example by ultrasonic welding, friction welding, or any other suitable process.

Where the mouthpiece has the alternative construction described above and as illustrated in FIG. 8, the mouthpiece assembly station may additionally include a delivery system the for screens 16*a* that close the end of container 10 that lies with in the mouthpiece. This delivery system (not illustrated), may be constructed and arranged to transfer successive screens from a source of supply, and to deliver the screens in an orderly succession and in a desired orientation, and possibly in multiple streams, to the mouthpieces as they are delivered to the assembly tooling 34. For example, the screens may be in the form of a continuous strip of mesh or foil that is be advanced into the assembly tooling over the socket 14 of the mouthpiece, and the tooling may be constructed and arranged to insert the screens into the sockets 14 of the mouthpieces, prior to insertion of the container into the socket, so that a screen 16 is trapped between each mouthpiece and the associated container 10 as the container is inserted.

A transfer mechanism 38 in the first assembly station transfers mouthpiece assemblies 3 to the conveyor 28, which carries the mouthpiece assemblies 3 to the second assembly station 24.

The second assembly station, or dosing station, 24 comprises a transfer mechanism 48 constructed and arranged to transfers the mouthpiece assemblies 3 between the conveyor 28 and tooling 44 in the dosing station in an orderly succession and in a desired orientation. The dosing station also includes a material delivery system 40 constructed and arranged to deliver the particulate aerosolizable material from a source 42, such as a hopper, and to deliver the material in metered quantities to the dosing station tooling 44, which is constructed and arranged to load measured quantities, or doses, of the particulate material into the respective chambers 18 each successive container 10. The dosing operation may be carried out using any suitable process, for example syringe dosing, cavity dosing, using a vertical or horizontal cavity wheel dosing, or auger dosing and, depending on the nature of the particulate material, may be measured volumetrically or gravimetrically.

As indicated at 43 and 43*a* in FIG. 5 the tooling station may include weighing equipment for weighing the mouthpiece assemblies 3 before and after loading with tobacco to check that they contain the desired load of material.

The transfer mechanism 48 is constructed and arranged to transfer mouthpiece assemblies 3 with loaded containers back on to the conveyor 28, which advances the mouthpiece assemblies 3 on to the third assembly station 26.

The third assembly station, or closure station, comprises a transfer mechanism 58 constructed and arranged to transfer the carriages 80 containing mouthpiece assemblies 3, which have been filled with particulate material, between the conveyor 28 and tooling 54 in the closure station. The closure station includes a closure delivery system 50 constructed and arranged to transfer closures 22 from a source 52, such as a hopper containing individual closures or ribbon carrying the closures and to deliver the closures to the closure station tooling 54 in the appropriate orientation with respect to the containers 10 and in multiple streams as necessary. This may also include an unpacking operation 53 and/or a sorting operation 55, as indicated in FIG. 5. The closure may be in the form of a wire mesh, in which case the ordering and orientation of the closures may be effected for example in a centrifugal or bowl feed system. Alternatively, the closure may be in the form of a continuous strip or sheet of mesh or foil which may be delivered to the tooling from a reel and fed over the open ends of the containers 10 in the carriage 80, and sealed to the container.

The closure station tooling 54 is constructed and arranged to seal each successive container 10 with a respective closure 22 by bringing the closure and container together in axial and radial alignment, applying the closure 22 to the open end of the container, (indicated at 54*a* in FIG. 5) and joining the two components together, for example by ultrasonic welding, friction welding, or any other suitable process that does not affect the quality of the particulate material in the container (indicated at 54*b* in FIG. 5).

The transfer mechanism 58 is constructed and arranged to transfer carriages 80 containing mouthpiece assemblies 3 with loaded and sealed containers 10 back on to the conveyor 28. The conveyor 28 advances the carriages to the fourth station 29, which includes a transfer mechanism 59 constructed and arranged to transfer the carriages away from the conveyor 28 and on to the further conveyor 37 for further processing in the direction of the arrow B, for example to an inspection station for quality control, as indicated at 57 in FIG. 5. The end of the production process for the mouthpiece assemblies 3 is indicated at E in FIG. 5.

Figure 6:
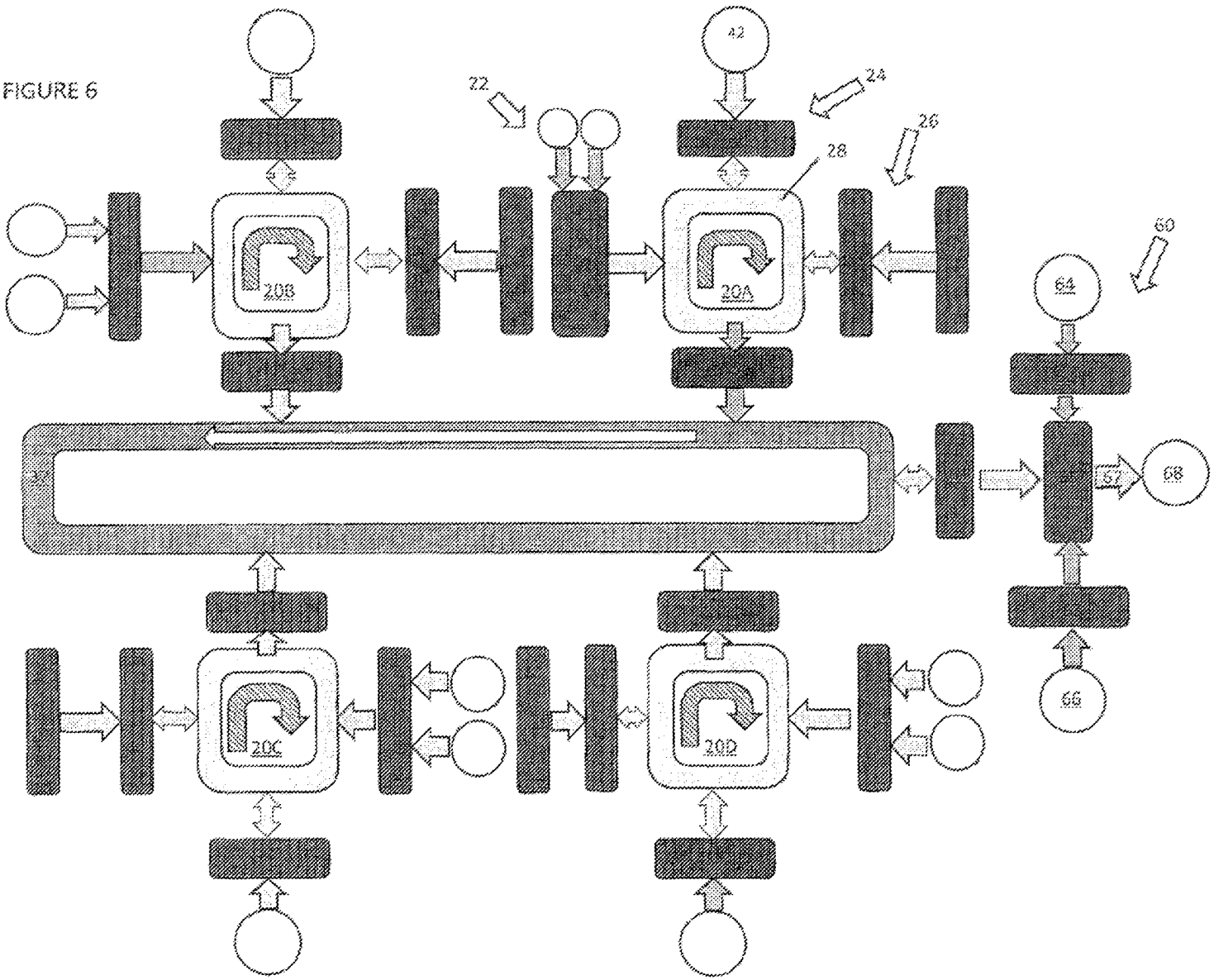
FIG. 6 is a schematic drawing of a second embodiment of equipment for the automated assembly of the mouthpiece assembly of FIGS. 2A and 2B and for packaging the assemblies into a retail sales unit with other components.

A second embodiment of equipment is illustrated in FIG. 6. In this example, the equipment is constructed and arranged to affect automated assembly of mouthpiece assemblies 3 and to package the devices and other components into a retail sales pack.

The speed of operation of the individual processes used in the assembly line described with reference to FIGS. 4 and 5 above is limited by the nature of the operations used in the process. These operations, particularly sorting and alignment of components of complex shape, welding and sealing, can be relatively slow. For example a single assembly line as described with reference to FIG. 4 may be capable of operation at a rate of production of up to 600 mouthpiece assemblies 3 per minute. However, subsequent stages performed on the assemblies may be operable at higher speeds. In particular, equipment for packaging the assemblies into retail units may be capable of operating at higher speeds, for example up 2000 pieces per minute. The equipment described with reference to FIG. 6 is constructed to deliver mouthpiece assemblies 3 to the packaging equipment at a rate that matches the optimum rate of operation of the higher speed equipment.

Referring to FIG. 6, the equipment comprises four separate assembly lines for the mouthpiece assemblies 3, indicated generally at 20A, 20B, 20C and 20D. Each of the assembly lines is constructed and operates in a similar way to first embodiment described above with reference to FIG. 4. Each line comprises a group of three assembly stations, indicated by reference numerals 22, 24, and 26 in first assembly line 20A. (Reference numerals for like parts of the other assembly 20B to 20D, have been omitted for the sake of clarity). The assembly stations in each line comprises tooling for performing the same separate assembly operations on the components of the mouthpiece as described with reference to FIG. 3, namely assembling the container and the mouthpiece, dosing the container with particulate material, and closing and sealing the container. Each line also includes a local conveyor 28 for advancing the components in carriages 80 through the stations and a transfer mechanism 59 constructed and arranged to transfer the assemblies off the conveyor 28.

The four stations are positioned around a common transport system provided by a conveyor 37 which defines a closed loop between the four assembly lines. This conveyor may be constructed using linear induction drive technology (XTS technology). Fully assembled and filled mouthpiece assemblies 3 are delivered to the conveyor 37 in carriages 80, each containing of ten units, by the respective transfer mechanisms 59 of the four assembly lines. The carriages 80 from the four lines are delivered by the conveyor 37 to a single packaging station 60. Since the conveyor delivers batches of mouthpiece assemblies 3 from each of the four assembly lines to the packaging station 60, the rate of delivery of mouthpiece assemblies 3 to the packaging station is four times the rate of production of the mouthpiece assemblies 3 at each assembly line 20A-20D.

The packaging station 60 comprises a transfer mechanism 61, a packaging material delivery system 62 and a delivery system 63 for the first consumable units, or atomiser cartridges 2. The transfer mechanism 61 removes the carriages 80 containing the mouthpiece assemblies 3 from the conveyor 37 and presents them to the packaging tooling in an order and orientation suitable for packing in the packaging material. The packaging delivery system 62 is constructed and arranged to transfer packaging materials from a source 64, such as a hopper, stack, reel or a packaging manufacturing line, and to deliver the materials in an appropriate orientation to packaging tooling 65. Similarly, the delivery system 63 for the atomiser cartridges 2 is constructed and arranged to transfer atomiser cartridges 2 from a store 66, such as a hopper or other source of supply, which may be an assembly line for the atomiser cartridges, and to deliver the atomiser cartridges in an orderly succession and in a desired orientation to the packaging tooling 65.

The packaging tooling 65 is constructed and arranged to enclose each successive atomiser cartridge 2 in a blister pack 110 together with three mouthpiece assemblies 3, as illustrated in FIG. 3A and 3B, and to seal the pack, for example by heat sealing.

A transfer mechanism 67 in the packaging station transfers the packages out of the packaging station to a delivery point 68 for further handling.

By providing multiple assembly lines for the mouthpiece assemblies 3, the packaging station may be supplied with components for packing at a rate enabling the packaging station to operate at its optimum speed.

As used herein, the terms "tobacco", or "particulate tobacco material", mean a material that includes tobacco, tobacco derivatives, expanded tobacco, reconstituted tobacco, or tobacco substitutes. The particulate material may also include a non-tobacco material.

It will be appreciated that the above described examples of a consumable unit may be used in devices other than the inhalation device described with reference to FIGS. 1A to 1C. For example, the inhalation device may be a device that releases compounds from the particulate material without burning, such as tobacco heating products. In one embodiment the inhalation device is a heating device which releases compounds by heating, but not burning, a substrate material, for example the particulate material. The particulate material may be for example tobacco or other non-tobacco products, which may or may not contain nicotine. In one embodiment the inhalation device is a tobacco heating device.

In another embodiment the tobacco industry product is a hybrid system to generate aerosol by heating, but not burning, a combination of substrate materials, for example the contents of the atomiser cartridge and the particulate material in the mouthpiece assembly. The substrate materials in the atomiser cartridge, and the particulate material in the mouthpiece assembly, may comprise for example solid, liquid or gel which may or may not contain nicotine. In one embodiment, the hybrid system comprises a liquid or gel substrate and a solid substrate. The solid substrate may be for example tobacco or other non-tobacco products, which may or may not contain nicotine. In one embodiment the hybrid system comprises a liquid or gel substrate and tobacco.

In order to address various issues and advance the art, the entirety of this disclosure shows by way of illustration various embodiments in which the claimed invention(s) may be practiced and provide for superior methods and equipment for the automated assembly of consumable units for use in an inhalation device. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure.

Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A system for the automated assembly of consumable units for use in an inhalation device from components that include a mouthpiece, a container defining a chamber for aerosolizable material, and a closure for the chamber, the system comprising:

at least one assembly line having one or more assembly stations that each comprises tooling for performing an assembly operation on the components; and a transport system for supplying the components to the assembly stations and advancing the components through the assembly stations in a sequence to assemble at least part of the device from the components, wherein the transport system comprises a conveyor for advancing the components through the assembly stations in a sequence to assemble the at least part of a device from the components, wherein the transport system further comprises a transfer mechanism associated with each assembly station, each transfer mechanism being configured to (i) transfer components out of its associated assembly station to the conveyor or to (ii) transfer components into its associated assembly station from the conveyor and out of its associated assembly station to the conveyor, wherein the transport system comprises a mouthpiece delivery system constructed and arranged to deliver mouthpieces in succession to a mouthpiece assembly station, and a container delivery system constructed and arranged to deliver containers in succession to the mouthpiece assembly station, and wherein the mouthpiece assembly station comprises tooling constructed and arranged to assemble a container and a mouthpiece in their operational configuration to form a container and mouthpiece assembly.

2. The system of claim 1, wherein the transport system comprises a transfer system constructed and arranged to transfer mouthpiece and container assemblies to a dosing station, and a material delivery system constructed and arranged to deliver the aerosolizable material to the dosing station; and the dosing station comprises tooling constructed and arranged to load measured quantities of the aerosolizable material into the respective chambers of each successive container.

3. The system of claim 1, comprising a further assembly station, a transfer system constructed and arranged to transfer consumable units from a common collection system to the further assembly station, and a component delivery system for delivering further components of the device to the assembly station, the assembly station being constructed and arranged to combine the consumable units with one or more further components.

4. The system of claim 3, wherein the further components comprise an operating unit of the inhalation device and a cartridge for atomizing a consumable liquid.

5. The system of claim 1, further comprising a packaging station, and a delivery system for transferring assembled consumable units to the packaging station, a packaging delivery system constructed and arranged to deliver packaging material to the packaging station, wherein the packaging station is constructed and arranged to pack the consumable units in the packaging material.

6. A system for the automated assembly of consumable units for use in an inhalation device from components that include a mouthpiece, a container defining a chamber for aerosolizable material, and a closure for the chamber, the system comprising:

at least one assembly line having one or more assembly stations that each comprises tooling for performing an assembly operation on the components; and a transport system for supplying the components to the assembly stations and advancing the components through the assembly stations in a sequence to assemble at least part of the device from the components, wherein the transport system comprises a conveyor for advancing the components through the assembly stations in a sequence to assemble the at least part of a device from the components, wherein the transport system further comprises a transfer mechanism associated with each assembly station, each transfer mechanism being configured to (1) transfer components out of its associated assembly station to the conveyor or to (ii) transfer components into its associated assembly station from the conveyor and out of its associated assembly station to the conveyor, wherein the transport system comprises a transfer system constructed and arranged to transfer mouthpiece and container assemblies to a dosing station, and a material delivery system constructed and arranged to deliver the aerosolizable material to the dosing station; and the dosing station comprises tooling constructed and arranged to load measured quantities of the aerosolizable material into the respective chambers of each successive container.

7. A system for the automated assembly of consumable units for use in an inhalation device from components that include a mouthpiece, a container defining a chamber for aerosolizable material, and a closure for the chamber, the system comprising:

a plurality of assembly lines each having one or more assembly stations that each comprises tooling for performing an assembly operation on the components; and a transport system for supplying the components to the assembly stations and advancing the components through the assembly stations in a sequence to assemble at least part of the device from the components, wherein the transport system comprises a conveyor for advancing the components through the assembly stations in a sequence to assemble the at least part of a device from the components, wherein the transport system further comprises a transfer mechanism associated with each assembly station, each transfer mechanism being configured to (1) transfer components out of its associated assembly station to the conveyor or to (ii) transfer components into its associated assembly station from the conveyor and out of its associated assembly station to the conveyor, wherein the system further comprises a common collection system for collecting consumable units from the assembly lines, the common collection system comprising carriages adapted to hold two or more of the assembled devices and each assembly line includes a transfer system constructed and arranged to load the assembled devices into the carriages.

8. The system of claim 7, wherein the transport system further comprises a transfer system for transferring loaded container and mouthpiece assemblies in succession to a closing station, and a closure delivery system constructed and arranged to deliver closures in succession to the closing station; and the closing station comprises tooling constructed and arranged to apply a closure to each successive container and mouthpiece assembly.

* * * * *